United States Patent [19]

Corbin

[11] Patent Number: 5,032,824

[45] Date of Patent: Jul. 16, 1991

[54] PERSONAL ALARM

[75] Inventor: Robert L. Corbin, Long Beach, Calif.

[73] Assignee: Pacific Electronic Technology, Inc., Long Beach, Calif.

[21] Appl. No.: 267,333

[22] Filed: Nov. 4, 1988

[51] Int. Cl.[5] ..... G08B 13/00

[52] U.S. Cl. ..... 340/574; 340/693; 116/DIG. 44

[58] Field of Search ..... 340/574, 693, 691, 523, 340/532, 321; 362/205; 116/DIG. 44

[56] References Cited

U.S. PATENT DOCUMENTS 4,703,402 10/1987 Hsieh ..... 362/205

4,731,604 3/1988 Pawlowski, Jr. ..... 340/574

*Primary Examiner*—Joseph A. Orsino

*Assistant Examiner*—Geoff L. Sutcliffe

*Attorney, Agent, or Firm*—Fulwider, Patton, Lee & Utecht

[57] ABSTRACT

A hand held personal alarm incorporating a high intensity light and loud horn and further incorporating a plurality of switches that are located a distance apart that prevents their actuation by the digits of a single hand or by pressing the alarm against a single surface. The switches provide the only means of deactivating the alarm once activated. An alternative embodiment includes a timing circuit that prevents deactivation of the alarm for a set period after activation. Both schemes prevent easy deactivation of the alarm by an assailant, thereby providing more protection than with conventional hand held alarms.

22 Claims, 5 Drawing Sheets

PERSONAL ALARM

BACKGROUND OF THE INVENTION

Alarm systems have become increasingly popular due to the recent increases in personal attacks, burglaries and muggings in urban areas. The relatively small number of police available to provide meaningful deterrance to robbers and assailants and the fact that most police in urban areas are motorized, has meant that many citizens have been motivated to rely upon personal and property protection alarms and security services on their premises that do not rely upon the conventional police forces in the community. Many of these protection devices utilize a high volume sound alarm however do not utilize a light, such as a strobe light, or a combination of these warning methods. Such devices would prove highly effective for certain applications where they may be used in a hand held assembly of the type that may be held and turned on by an individual. One problem with current alarms is that once activated, they can be disabled by the assailant or burglar using the same switch which the victim uses to activate the device. Once deactivated, the owner is no better off than before and is deprived of an important means to draw attention to his plight. Since such switches are generally obvious and their location is easily ascertained upon examination of the alarm, an alarm incorporating such a switching system does not provide a full measure of deterrance that a sound alarm and flashing light could provide.

Other configurations have been used, such as those that require a key to turn them off or other elaborate switching methods, but such systems are neither convenient or cost effective for a hand held personal alarm of the type that can be carried on the person.

There remains, therefore, the continuing need for a hand held alarm system which may be rapidly enabled by the owner of the system, but which is difficult for an assailant to disable.

SUMMARY OF THE INVENTION

Personal alarm devices that incorporate stroboscopic lights and extremely loud sound alarms can be very effective for driving away assailants or would be robbers due to the fact that the alarm will draw attention to the activity taking place and its location, even over great distances. Furthermore, the presence of a simultaneous loud alarm and bright flashing light encourages a passerby or law enforcement officer to perform an inquiry into the nature of an activity. Such an inquiry might not otherwise occur were the alarm not activated, especially at night. The present invention utilizes these beneficial characteristics of such a simultaneous sound and light alarm in combination with a unique switching system which prevents the alarm from being easily disabled by an assailant or robber. The switching system may be implemented in one of two ways: 1) by the use of a pair of switches separated by a distance of the body of the alarm that makes it difficult, if not impossible, to depress them simultaneously with one hand and which deactivates a latching circuit and therefore must both be depressed for a preset time period, or 2) by use of a time delay circuit that disables the alarm upon a predetermined period after the activitating switch is depressed. Even with knowledge of the logic associated with either of the schemes being used, an assailant or robber who attempted to disable such a device would be unsuccessful for a lengthly period of time, thereby allowing an alarm to remain active long enough to, hopefully, deter the aggressive act.

While the circuits used for the various implementations of the present invention represent the above referenced alternatives in the disabling circuit, the enabling circuit and electronic alarm system include a structure representing their own novel and useful features. The invention incorporates a on-off control switching circuit which activates a power switching and conversion circuit powered from the primary power source, generally consisting of a nickle cadmium (NiCd) battery. This power switching and conversion circuit then activates a switch connecting an auxillary power supply to the audible alarm circuits and separately activates a high voltage power supply that provides energy to a storage capacitor and trigger circuit used to flash a xenon flash tube. The horn activation circuit, operated from the auxillary power supply contained in the unit, provides activation to the timer circuits that can provide for automatic turnoff after a predetermined period of time.

The electronics and alarm system are encased in a single, robust, compact unit with strap that may be easily carried in the purse, pocket or on the wrist to allow for rapid use in the event of an assault. The unit is configured so that it provides the means of pointing the flash and horn in the general direction of the assailant, thereby possibly blinding and deafening him to a degree which may allow escape. In the embodiment of the invention that makes use of manual disabling switches, the disabling switches for the system are located at opposite ends of the alarm so that they cannot be depressed with a single hand placed around the object, thereby making the disablement of the device by accident or an assailant, an extremely unlikely occurrence. To enhance and reinforce this feature, the alarm is made of a high impact plastic and is fitted with a strap that can encircle the wrist of the user, thereby preventing the assailant from easily throwing or smashing the alarm. Thus, the present invention provides, in a single compact unit, the means to activate an audio and visual alarm which is not easily disabled by the assailant. Other features and advantages of the invention will become apparent from the following detailed description, taken in conjunction with the accompanying drawings which illustrate, by way of example, the features of the invention.

DETAILED DESCRIPTION OF THE INVENTION

Figure 1:
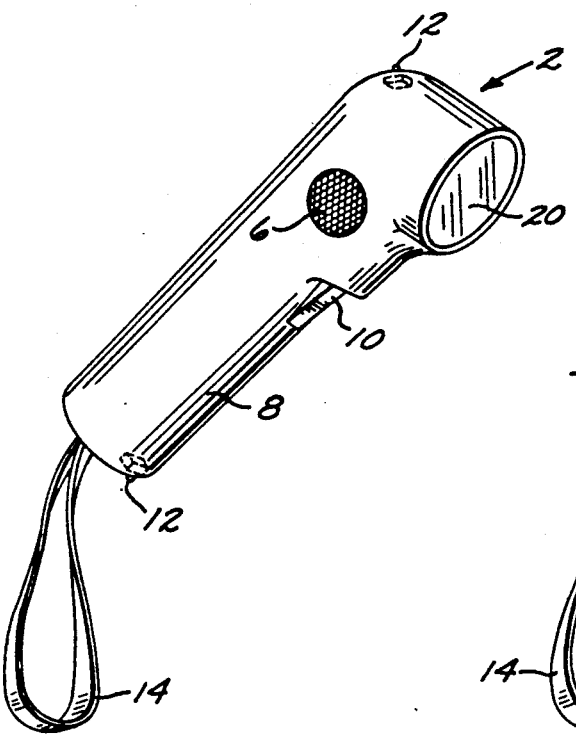
FIG. 1 is a perspective view of the personal alarm of the present invention illustrating the exterior features of the case and the basic placement of the alarm and switching components.

As shown in the exemplary drawings, the invention is embodied in a personal alarm 2 of the type having a stroboscopic light 16 and a loud sound emitting horn 6 housed in a robust housing 8. Housing 8 incorporates a switch 10 to activate the alarm and a pair of switches 12 separated on and recessed into the housing in such a way that it is unlikely to simultaneously activate both deactivation switches with a single hand or upon a surface, thereby preventing accidental or easy deactivation of the alarm by an assailant. An alternative preferred embodiment incorporates electronic circuitry which prevents deactivation of the alarm, once activated, for a predetermined period of time thereby preventing an assailant from deactivating the alarm by pressing or otherwise pushing any of the controls on the alarm.

The steady increase in the number of personal assaults, rapes and muggings against individuals has caused many persons to equip themselves with personal alarms or other self-defense devices to discourage such attacks. One type of such personal alarm incorporates a high volume sound alarm, a bright light or combination of the two, in a small case enclosing the alarm, an electronic circuit and a switch to turn the alarm on and off. Variations of these devices have included similar alarms that also incorporated a switch or switches to disable the alarm once activated.

A common problem with such alarms has been the relative ease with which they may be disabled, either by inspection or experimentation, due to the simple switching systems that they employ. Also, such personal security devices have generally been of relatively fragile construction and once ripped from the hands of the victim, can be disabled by smashing them against the ground or another nearby object. The limitations of such relatively simple personal alarms has prevented them from being truly effective and has relegated them to novelty status which they currently enjoy. More elaborate systems designed to protect high value property such as expensive automobiles and business facilities, employ more elaborate and sophisticated alarms with enhanced ability to resist tampering or disablement by a criminal. It may readily be seen that there remains a continuing need for personal security devices that are capable of attracting attention to an assault in progress, are easily activated by the intended victim and are not easily disabled by an assailant. The present invention provides solutions to these problems in a compact, relatively inexpensive and rugged package.

FIG. 1 is a perspective view of a personal alarm incorporating the invention. The alarm 2 consists of a xenon flash tube 16 and a loud audio alarm 6 housed in a high impact plastic housing 8 that incorporates switch 10 used for activating the alarm and a plurality of switches 12 located a distance apart on the housing that prevents actuation of the switches by either contact of the alarm against a surface or pressing the switches with the fingers of a single human hand. Thus, deactivation of the alarm requires the use of both hands pressing the switches simultaneously for a given period of time, thereby providing an opportunity for the victim to escape or, in the alternative, preventing the deactivation of the alarm by the assailant. In practice, the distance that switches 12 may be placed apart is a function of the configuration of housing 8 and the type of switches used, but one advantageous arrangement illustrated in FIG. 1, is to make the switches of the recessed variety located approximately eleven (11) inches apart and recessed into opposing surfaces at the extremity of the housing 8, thereby effectively preventing the fingers of a single hand from reaching and activating the deactivation switches.

Hand loop 14 is attached to housing 8 and allows the operator to place the loop around his hand or wrist thereby preventing an assailant from seizing the alarm and throwing it away or smashing it.

Figure 2:
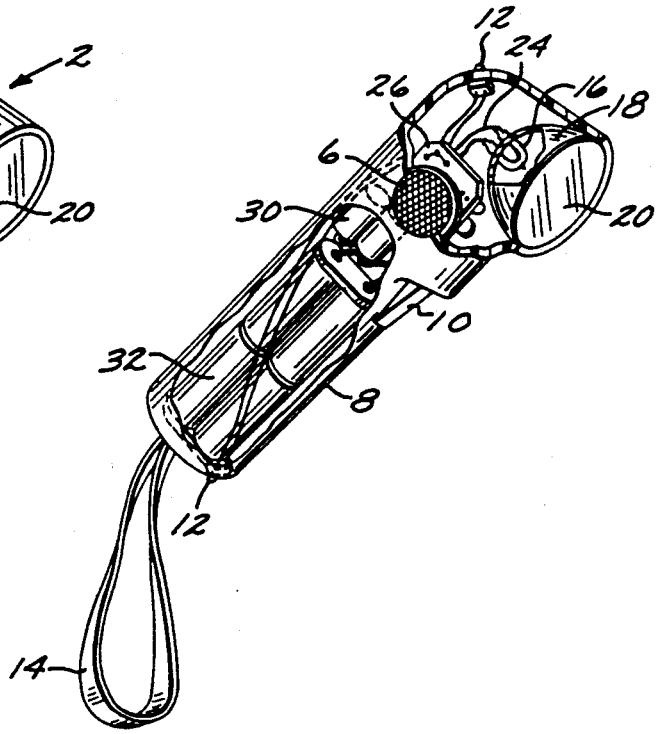
FIG. 2 is a cutaway, sectional view of the personal alarm of the present invention illustrating the placement of components within the alarm housing.

FIG. 2 is a cut-away perspective view of the present invention, illustrating the arrangement of the various components. The housing 8 of alarm 2 encloses, protects and provides mounting for the electronic, mechanical and electro-mechanical parts of the alarm. Xenon flash tube 16 and its attendant reflector 18 and front protective lens 20, are mounted in one extremity of the alarm and are connected by wires 24 to electronic circuit board 26 incorporating the electronic components used to operate flash tube 16 and audio alarm 6. Switch 10 is mounted in housing 8 to allow for easy initial operation of the alarm. Primary battery pack 32, of the rechargeable nickle cadmium type, is mounted adjacent to electrical circuit board 26. A power supply 30 consisting of storage batteries 32, is mounted in the handle of housing 8 and provides the high power energy source necessary for the continued operation of the flash tube 16 and horn 6. Switches 12 are located at the extremities of the alarm and provide the means to disable the alarm. The switches are separated by a distance that makes it difficult, if not impossible, for their simultaneous depression by a surface and/or one human hand. Thus, it can be seen that the configuration of the housing and the switching system of the present invention make it difficult, if not impossible, for an assailant to disable the alarm by placing it against a surface and/or using a single hand in an attempt to reach switches 12. A hand or wrist strap 14 can be used to encircle the hand or wrist of the operator, thereby preventing the easy removal of the alarm from the person using the alarm and further discouraging an assailant from attempting to disable the alarm.

Figure 3:
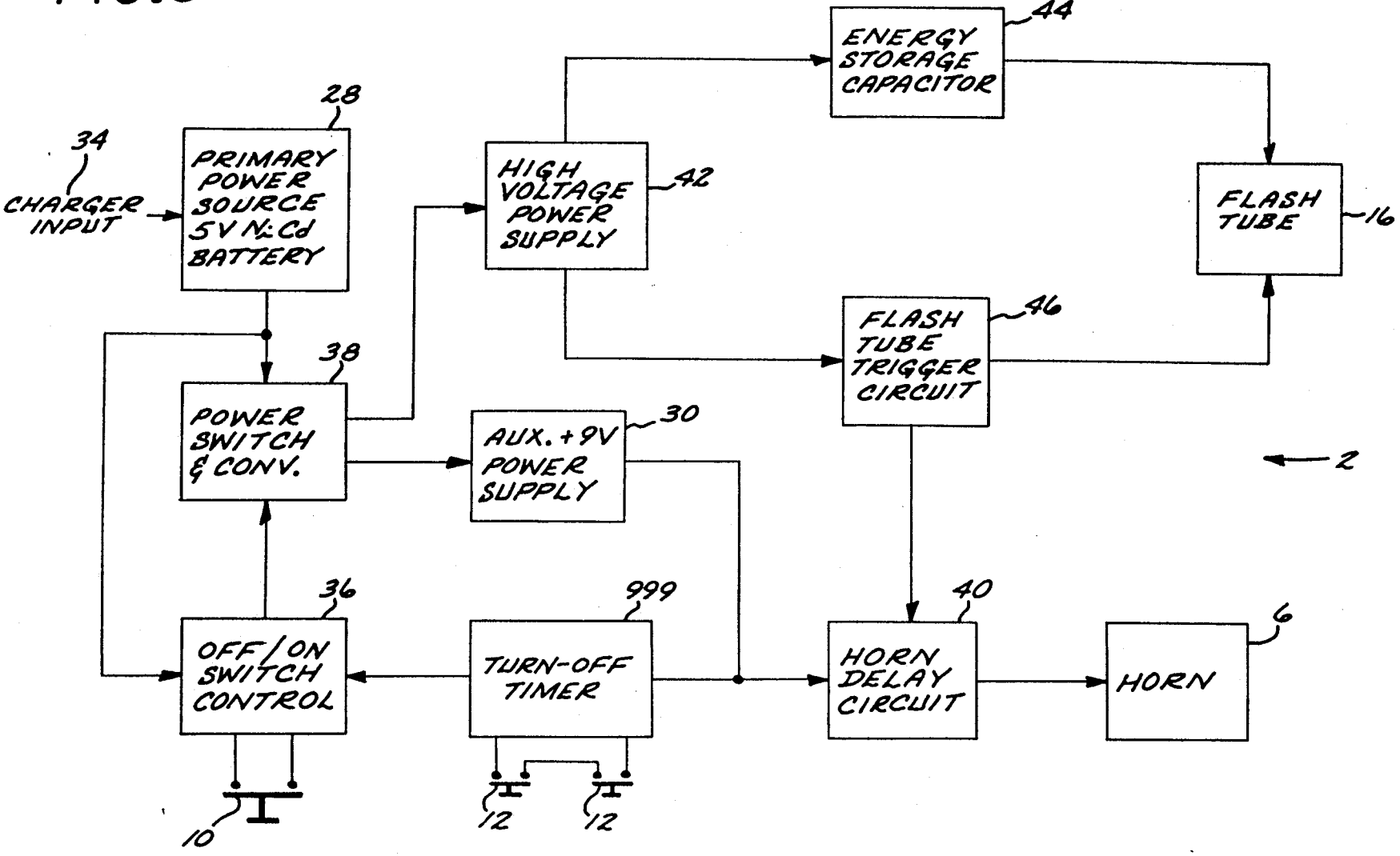
FIG. 3 is a block diagram illustrating the placement and signal flow between the major sub-systems of the alarm of the present invention incorporating delayed-action dual deactivation switches.

FIG. 3 is a block diagram of the present invention illustrating the relationship of the major functional blocks in the system. Alarm 2 incorporates a primary power supply 28 consisting of nickle cadmium batteries that may be recharged through charger input 34. Control switch 10 operates switch control circuit 36, and allows current to flow from the primary battery supply 28 to a power switch conversion circuit 38. The power switch conversion circuit 38 actuates an auxillary power supply 30 that is then fed to the horn delay circuit 40 and thence to the high volume audio horn 6. This power switch and conversion circuit 38 also allows current to flow to a high voltage power supply 42. High voltage power supply 42 feeds the current to an energy storage capacitor 44 that is discharged upon triggering of flash tube 16 by flash tube trigger circuit 46. Once activated, the circuit may only be disabled by simultaneous depression of the two switches 12 in the feedback loop from the auxillary 9 volt power supply 30. The switch control circuit 36 operating as a latching mechanism which may only be disabled upon the activation of switches 12 for a predetermined time period determined by manual turn off timer circuit 999 by someone familiar with the alarm, thus preventing the accidental disabling of the alarm or easy disabling of the alarm by activation of a single control.

Figure 4:
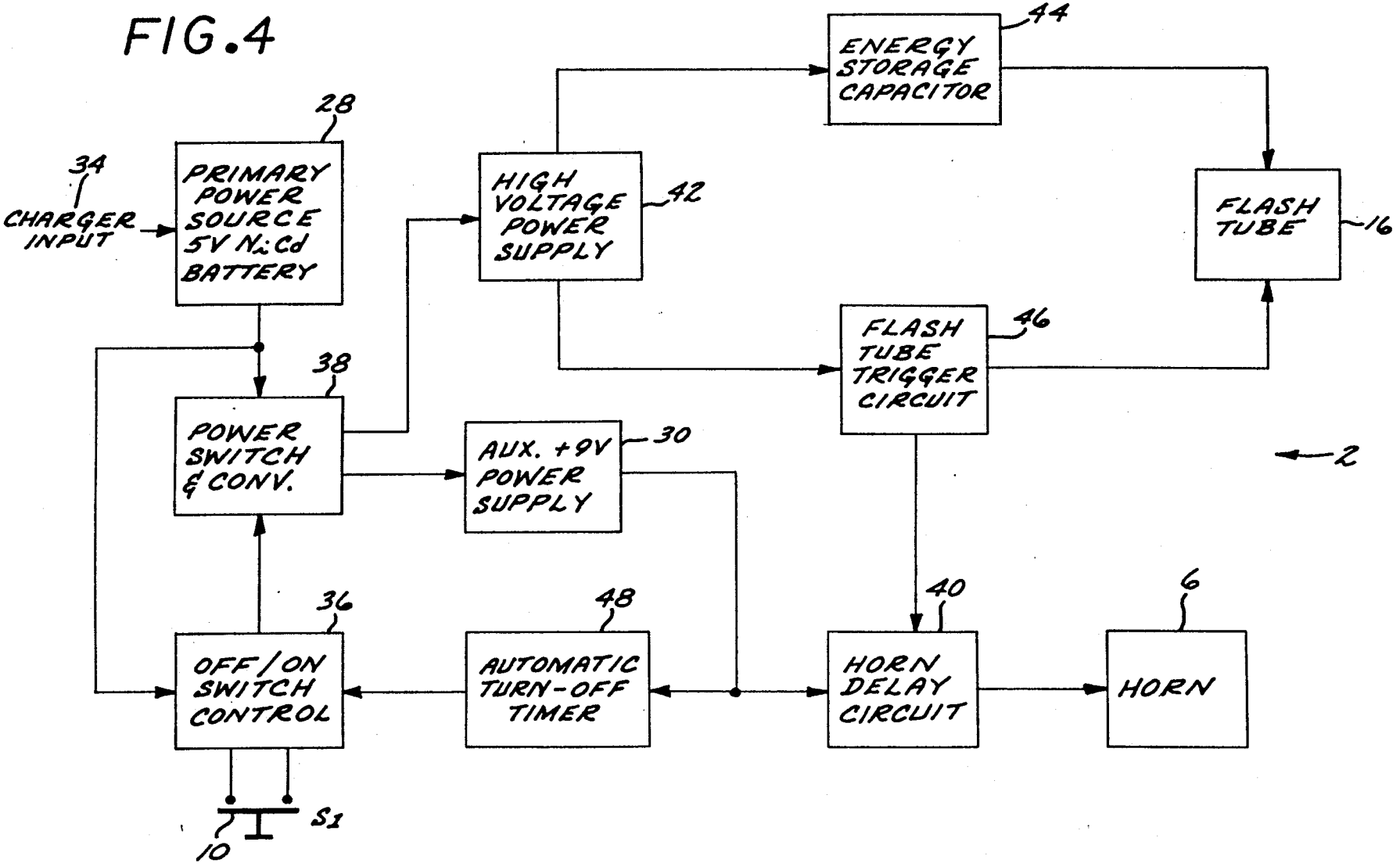
FIG. 4 is a block diagram of the present invention illustrating the arrangement of components for the embodiment incorporating an automatic shut-off timer for the alarm.

FIG. 4 is a block diagram of the alarm of the present invention which incorporates an alternative embodiment in which the switches 12 of FIG. 3 are replaced with an automatic turn-off timer 48 to prevent deactivation of the alarm until after a certain time period has expired. In a manner similar to the apparatus of the circuit of FIG. 3, the primary power source, a nickle cadmium battery 28 is connected to power switch and conversion circuit 38 when the turn on switch control 36 is activated by depression of switch 10. Depression of switch 10 latches the power switch and conversion circuit 38 on and activates auxillary 9 volt power supply 30 to feed forward to horn delay circuit 40 and horn 6. High voltage power supply 42 receives current from power switch and conversion circuit 38 and routes current to energy storage capacitor 44 and flash tube trigger circuit 46 which operate to flash xenon flash tube 16 repetitively. Automatic turn off timer circuit 48 incorporates a timer which deactivates switch control 36 after a certain period of operation of auxillary 9 volt power supply 30.

Figure 5:
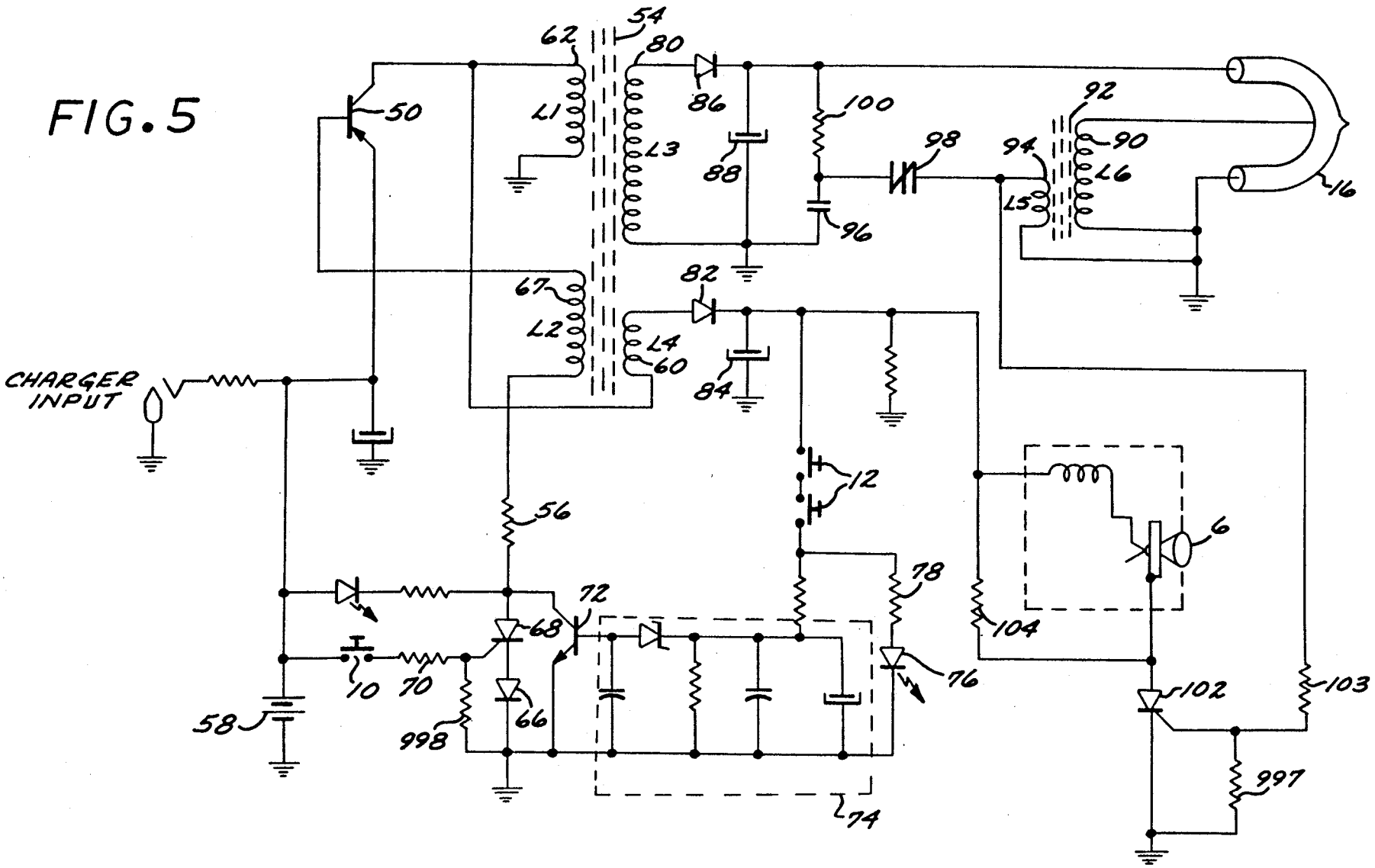
FIG. 5 is a circuit diagram of the present invention illustrating the component arrangement for the embodiment of the invention incorporating delayed-action dual switches for deactivating the alarm.

FIG. 5 is an electrical schematic of the electronic system of the present invention incorporating the dual switching deactivation system and equivalent to block diagram of FIG. 3. When turn on switch control 10 is activated, it applies forward bias to transistor 50 through the inductive winding 67 on transformer 54. The forward bias conduction path is through diode 66, silicon control rectifier 68 and resistor 56. Resistor 56 sets the forward bias current for power transistor 50. The power transistor 50 has a dual role. When the alarm is activated, power transistor 50 switches the battery 58 in series with transformer winding 60 on transformer 54. Power transistor 50 also serves as a power convertor oscillator and in conjunction with transformer power winding L1 62 and feedback winding L2 67 and form the power converter oscillator. The forward bias of power transistor 50 is provided through transformer winding L2 67 from the turn on switch control through resistor 56, diode 66 and silicon control rectifier (SCR) 68. The conduction path is completed when SCR 68 is activated upon depression of switch 10. Thus, the SCR 68 gate current flows through resistor 70 which limits the SCR 68 gate current. Resistor 998 desensitizes the gate circuit of SCR 68 thus preventing spurious alarm activation. Once activated, SCR 68 will hold, in the ON state, since the power transistor 50's forward bias is higher than the SCR 68's minimum holding current requirement. The conductive path of SCR 68 is commuted, thus turning the alarm off when SCR 68's holding current is brought below the holding current value. Transistor 72 provides a low resistance path around SCR 68, thus shunting power transistor 50's forward bias around SCR 68 and through transistor 72 thereby reducing SCR 68's holding current below the holding current value described above. Transistor 72 is activated by the timer block represented by the timer network 74. Diode 66 assures that the saturation voltage of transistor 72 is always less than the saturation voltage of SCR 68. Light emitting diode (LED) 76, which incorporates current limiting resistor 78, indicates to the operator that the alarm deactivation sequence has been successfully initiated.

The nine volt auxillary power supply 30 is formed by stacking transformer winding L4 60 in series with the battery 58. The winding L4 60 provides approximately seven volts to the power supply. Diode 82 is employed as a rectifier and capacitor 84 is employed as a filter. When the alarm is deactivated, battery 58 is disconnected from the nine volt power supply, thus preventing continued current from flowing to horn 6 through transformer winding L4 60 and diode 82.

The high voltage power supply is formed by transformer winding L3 80 and rectifier diode 86. By use of the high voltage power supply, the voltage at energy storage capacitor 88 is raised to approximately 300 volts. The current stored by energy storage capacitor 88 provides current for xenon flash tube 16 when the flash tube 16 is ionized. The flash tube is ionized when a high voltage pulse is received from secondary winding L6 90 of transformer 92 and is applied to flash tube 16. The primary winding L5 94 of transformer 92 is driven by the discharge of capacitor 96 through SIDAC trigger diode 98. Capacitor 96 is discharged into transformer winding L5 94 when the breakover voltage of SIDAC trigger diode 98, nominally about 135 volts, is exceeded. Resistor 100 is the charging resistor for capacitor 96. Resistor 100 and capacitor 96 also form a delay network to allow the energy storage capacitor 88 reach it's optimum charge voltage.

The horn delay circuit delays the activation of horn 6 until the first ionization of flash tube 16 and then holds the horn 6 in the ON mode until the alarm is deactivated. Horn 6 is activated when SCR 102 is triggered ON. The trigger signal flows from the flash tube trigger when SIDAC diode 98 breaks over and discharges capacitor 96. SCR 102's gate shunting resistor 997 desensitizes SCR 102's gate circuit. Horn shunting resistor 104 provides a greater than minimum SCR 102 holding current such that horn 6 does not deactivate SCR 102 when horn 6's interrupter contacts are broken. If this were not to occur, the normal interruptor contact breakage by horn 6 would turn off SCR 102 thereby reducing SCR 102's holding current to zero.

Thus, this embodiment of the present invention cannot be disabled unless both switches 12 are pressed simultaneously for a predetermined period to activate timing circuit 74, thereby preventing the rapid deactivation of the alarm and then only by the use of both hands.

Figure 6:
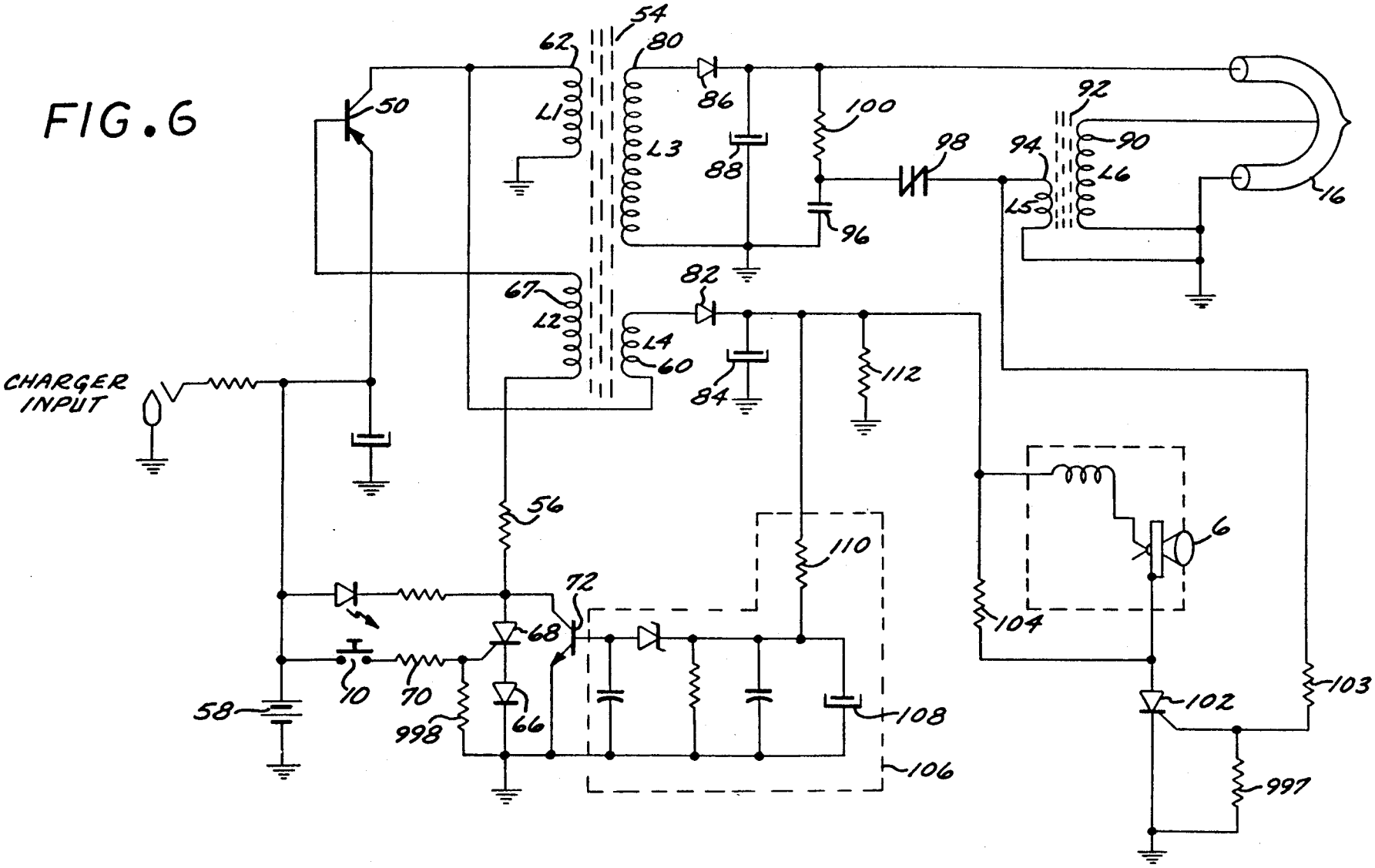
FIG. 6 is a circuit diagram of the present invention illustrating the component arrangement for the embodiment of the invention incorporating an automatic time delay circuit for deactivating the alarm.

FIG. 6 is an electrical schematic of the automatic shutoff electronic system of the present invention incorporating the switching system of an alternative embodiment to the present invention and equivalent to block diagram of FIG. 4. Parts of this embodiment that are in substantial correspondence in structure and function with those of FIG. 5 are designated with corresponding reference numerals. When turn on switch control 10 is activated, it applies forward bias to transistor 50 through the inductive winding 67 on transformer 54. The forward bias conduction path is through diode 66, SCR 68 and resistor 56. Resistor 56 sets the forward bias current for power transistor 50. As with the other embodiment, the power transistor 50 has a dual role. When the alarm is activated, power transistor 50 switches the battery 58 in series with transformer winding L4 60 on transformer 54. Power transistor 50 also serves as a power converter oscillator and in conjunction with transformer power winding L1 62 and feedback winding L2 67 and form the power converter oscillator. The forward bias of power transistor 50 is provided through transformer winding L2 67 from the turn on switch control by resistor 56, diode 66 and SCR 68. The conduction path is completed when SCR 68 is activated upon depression of switch 10. Thus, the SCR 68 gate current flows through resistor 70 which limits the SCR 68 gate current. Resistor 998 desensitizes the gate circuit of SCR 68, thus preventing spurious alarm activation. Once activated, SCR 68 will hold in the ON state, since the power transistor 50's forward bias is higher than the SCR 68's minimum holding current requirement. The conductive path of SCR 68 is commuted, thus turning the alarm off when SCR 68's holding current is brought below the holding current value. Transistor 72 provides a low resistance path around SCR 68 thus shunting power transistor 50's forward bias around SCR 68 and through transistor 72 thereby reducing SCR 68's holding current below the holding current value described above. Transistor 72 is activated by the timer block represented by the timing and delay network 106. Diode 66 assures that the saturation voltage of transistor 72 is always less than the saturation voltage of SCR 68. The turn off timer of this embodiment provides forward bias to transistor 72. The timing period, which may be altered by suitable choice of the resistor and capacitor values in timer block 106, commences when the alarm is activated by switch 10 and terminates when capacitor 108 in network 106 is highly charged. Charging current for capacitor 108 is through resistor 110. Resistor 112 provides a discharge path for auxillary power supply capacitor 84.

The nine volt auxillary power supply is formed by stacking transformer winding L4 60 in series with the battery 58. The winding L4 60 provides approximately seven volts to the power supply. Diode 82 is employed as a rectifier and capacitor 84 is employed as a filter. When the alarm is deactivated, battery 58 is disconnected from the nine volt power supply, thus preventing continued current from flowing to horn 6 through transformer winding L4 60 and diode 82.

The high voltage power supply is formed by transformer winding L3 80 and rectifier diode 86. By use of the high voltage power supply, the voltage at energy storage capacitor 88 is raised to approximately 300 volts. The current stored by energy storage capacitor 88 provides current for xenon flash tube 16 when the flash tube 16 is ionized. The flash tube 16 is ionized when a high voltage pulse from secondary winding L6 90 of transformer 92 is applied to the flash tube 16. The primary winding L5 94 of transformer 92 is driven by the discharge of capacitor 96 through SIDAC trigger diode 98. Capacitor 96 is discharged into transformer winding L5 94 when the breakover voltage of SIDAC trigger diode 98, nominally about 135 volts, is exceeded. Resistor 100 is the charging resistor for capacitor 96 and resistor 100 and capacitor 96 also form a delay network to allow the energy storage capacitor 88 to reach it's optimum charge voltage.

The horn delay circuit delays the activation of horn 6 until the first ionization of flash tube 16 and then holds the horn 6 in the ON mode until the alarm is deactivated. Horn 6 is activated when SCR 102 is triggered ON. The trigger signal flows from the flash tube trigger when SIDAC diode 98 breaks over and discharges capacitor 96. Resistor 103 provides current limiting of SCR 102's gate circuit while resistor 997 desensitizes SCR 102's gate circuit. A horn shunting resistor 104 provides a greater than minimum SCR 102 holding current such that horn 6 does not deactivate SCR 102 when horn 6's interruptor contacts are broken. If this were not to occur, the normal interruptor contact breakage of horn 6 would turn off SCR 102 thereby reducing SCR 102's holding current to zero.

Thus, this embodiment of the present invention provides for an automatic delay discontinuance of the alarm once activated by switch 10. Therefore, the assailant will be unable to prevent the continued operation of the alarm once activated by the owner until the delay period has expired.

While two particular forms of the invention have been illustrated and described, it will also be apparent to those skilled in the art, that various modifications can be made without departing from the spirit and scope of the invention. Accordingly, it is not intended that the invention be limited, except by the appended claims.

What is claimed is:

1. A housing incorporating a plurality of first switches, said first switches located a distance apart that prevents their simultaneous operation by the digits of a single hand, said housing further incorporating means to mount at least one alarm and means to mount electronics to activate said alarm;

alarm means mounted in said housing;

an electronic circuit mounted in said housing, operative to actuate said alarm means upon activation by a human operator;

said electronic circuit further comprising means to discontinue said alarm upon simultaneous depression of said first switches for a predetermined period of time; and energy storage means to power said electronic circuit and said alarm.

2. The personal alarm of claim 1 wherein said alarm means comprises a high sound volume horn.

3. The personal alarm of claim 1 wherein said alarm means comprises a high intensity light.

4. The personal alarm of claim 1 wherein said alarm means comprises, in combination, a high volume horn and a high intensity light.

5. The personal alarm of claim 1 wherein said means to actuate said electronic circuit comprises a second switch.

6. The personal alarm of claim 1 wherein said means to disable said alarm comprises time delay switching means controlling said electronic circuit.

7. The personal alarm of claim 3 wherein said high intensity light further comprises a xenon flash tube.

8. The personal alarm of claim 1 wherein said energy storage means further comprises, in combination, a relatively low voltage, low capacity battery to power said electronic circuit and a relatively higher voltage, higher capacity battery to power said alarm.

9. A personal alarm system which comprises:

means to emit an alarm;

electronic means to activate said alarm;

means to activate said electronic means;

means to deactivate said electronic means;

means to house said alarm means, said electronic means, said means to activate said electronic means and means to automatically deactivate said electronic means;

whereby said means to deactivate said electronic means to activate said alarm is not operable by a single action by an individual hand or a plurality of actions by a single human hand.

10. The personal alarm of claim 9 wherein said alarm means comprises a high sound volume horn.

11. The personal alarm of claim 9 wherein said alarm means comprises a high intensity light.

12. The personal alarm of claim 9 wherein said alarm means comprises, in combination, a high volume horn and a high intensity light.

13. The personal alarm of claim 9 wherein said means to actuate said electronic means comprises a switch.

14. The personal alarm of claim 9 wherein said means to disable said alarm comprises automatic time delay switching means controlling said electronic means.

15. The personal alarm of claim 11 wherein said high intensity light further comprises a xenon flash tube.

16. A personal alarm which comprises:

an electrically activated alarm;

energy storage means;

electronic means operative to convert electrical energy from said energy electrical storage means to activate said alarm;

first switch means to activate said electronic means; and means to disable said alarm, said means further comprising a plurality of second switch means located a distance apart, said distance sufficient to prevent deactivation of said alarm by contact with single human hand; and/or other object or objects; and means to house said energy storage means, said electronic means, said activation means and said disabling switches.

17. The personal alarm of claim 16 wherein said alarm means comprises a high sound volume horn.

18. The personal alarm of claim 16 wherein said alarm means comprises a high intensity light.

19. The personal alarm of claim 16 wherein said alarm means comprises, in combination, a high volume horn and a high intensity light.

20. The personal alarm of claim 16 wherein said means to disable said alarm comprises time delay switching means controlling said electronic means.

21. The personal alarm of claim 18 wherein said high intensity light further comprises a xenon flash tube.

22. The personal alarm of claim 16 wherein said energy storage means further comprises, in combination, a relatively low voltage, low capacity battery to power said electronic means and a relatively higher voltage, higher capacity power converter to power said alarm.

* * * * *